United States Patent [19]

Steinberg

[11] Patent Number: 4,715,304

[45] Date of Patent: Dec. 29, 1987

[54] HYDROFOIL MARINE APPARATUS

[76] Inventor: Amiram Steinberg, Moshav Avichail, Israel

[21] Appl. No.: 856,439

[22] Filed: Apr. 22, 1986

Related U.S. Application Data

[63] Continuation of Ser. No. 690,978, Jan. 11, 1985, abandoned.

[51] Int. Cl.[4] ..... B63B 1/28

[52] U.S. Cl. ..... 114/39.2; 114/274; 114/280

[58] Field of Search ..... 114/39.1, 39.2, 271, 114/274, 280–282; 441/74; D12/309

[56] References Cited

U.S. PATENT DOCUMENTS

| | | | |
|---|---|---|---|
| 2,991,747 | 7/1961 | Bader et al. | 114/282 |
| 3,164,117 | 1/1965 | Lopez | 114/282 |
| 3,183,871 | 5/1965 | Reder | 114/282 |
| 3,357,389 | 12/1969 | Wray | 114/282 |
| 3,789,789 | 2/1974 | Cleary | 114/280 |
| 3,871,322 | 3/1975 | Dodge | 114/127 |
| 4,040,373 | 8/1977 | Jones | 114/280 |

FOREIGN PATENT DOCUMENTS

| | | | |
|---|---|---|---|
| 2610790 | 9/1977 | Fed. Rep. of Germany | 114/39.2 |
| 2731266 | 2/1979 | Fed. Rep. of Germany | 114/39.2 |

*Primary Examiner*—Joseph F. Peters, Jr.
*Assistant Examiner*—Stephen P. Avila
*Attorney, Agent, or Firm*—Browdy and Neimark

[57] ABSTRACT

Hydrofoil marine apparatus comprising a hull, a pair of hydrofoils, each including first and second planar surface portions, pivotal mounting apparatus for mounting the pair of hydrofoils onto the hull, and apparatus for selectably and variably determining the dihedral angle between the first and second planar surface portions.

19 Claims, 9 Drawing Figures

HYDROFOIL MARINE APPARATUS

This application is a continuation of application Ser. No. 690,978, filed 1/11/85, now abandoned.

FIELD OF THE INVENTION

The present invention relates to marine devices, such as windsurfing craft and sailboats, and more particularly to marine devices employing retractable hydrofoils.

BACKGROUND OF THE INVENTION

A great variety of hydrofoil marine craft exists and is described in the patent literature. Retractable hydrofoils appear in a number of contexts. In U.S. Pat. No. 3,789,789, there is described a hydrofoil sailing craft including an outrig onto which are pivotably mounted hydrofoils whose dihedral angle to the horizontal may be adjusted during operation.

U.S. Pat. No. 3,520,267 describes a pivotably mounted uniplanar hydrofoil stabilizer for a boat hull. U.S. Pat. No. 4,040,373 describes steering and stabilization apparatus for watercraft including vane members including two portions angled with respect to each other, which vane members are pivotable about an axis disposed in a horizontal plane.

Adjustably positionable hydrofoil craft are also shown, inter alia, in U.S. Pat. Nos. 3,168,067; 3,765,356; 4,027,614; and 4,356,786.

SUMMARY OF THE INVENTION

The present invention seeks to provide hydrofoil marine device of relatively simple construction which provides significant operational flexibility in use.

There is thus provided in accordance with an embodiment of the present invention hydrofoil marine apparatus comprising a hull, a pair of hydrofoils, each including first and second planar surface portions, pivotal mounting apparatus for mounting the pair of hydrofoils onto the hull, and apparatus for selectably and variably determining the dihedral angle between the first and second planar surface portions.

Further in accordance with a preferred embodiment of the invention, the first and second planar surface portions are interconnected in series.

Additionally in accordance with an embodiment of the invention, flaps are provided on at least one of the first and second planar surface portions.

Further in accordance with an embodiment of the invention, the dihedral angle determining apparatus comprises tensioned band displacement transmission apparatus. Preferably this apparatus is automatically operable in response to predetermined pivotal positioning of the pair of hydrofoils.

BRIEF DESCRIPTION OF THE DRAWINGS

The present invention will be understood and appreciated more fully from the following detailed description taken in conjunction with the drawings in which.

DETAILED DESCRIPTION OF THE INVENTION

Figure 1:
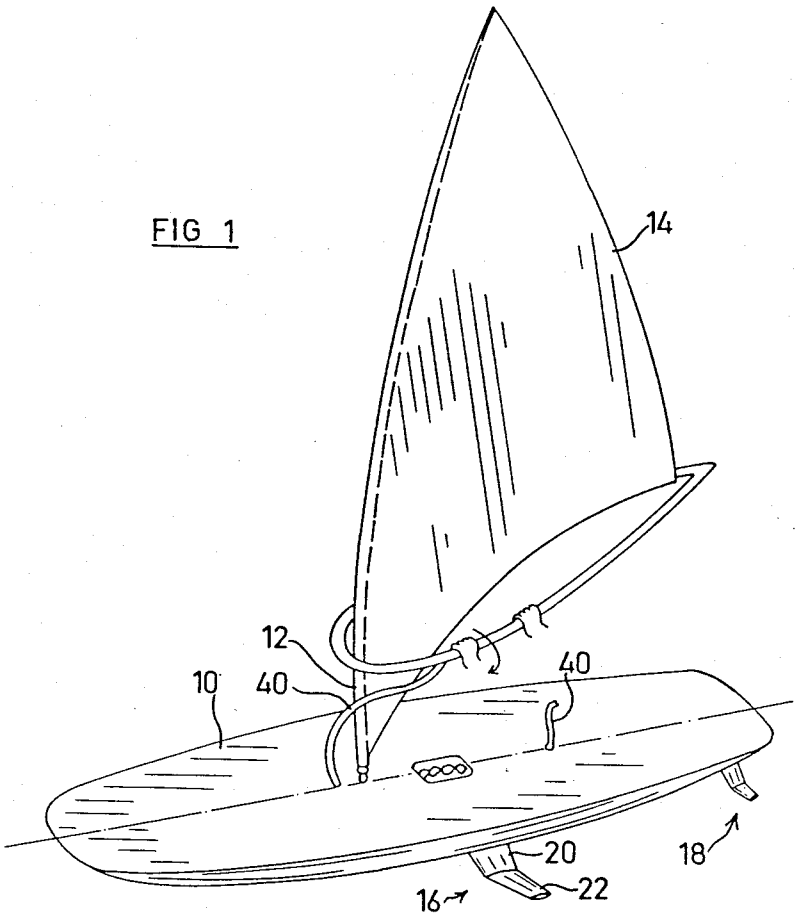
FIG. 1 is a pictorial view of a sailing craft constructed and operative in accordance with an embodiment of the present invention.

Reference is now made to FIG. 1, which illustrates a sailing craft suitable for windsurfing, constructed and operative in accordance with an embodiment of the present invention. It is noted that although the present invention is described herein with particular reference to sailing craft in general and to windsurfing type sailing craft in particular, this is for the purpose of simplicity and clarity of description. The present invention applies equally to any other type of marine apparatus such as powered vessels of any type and size which are suitable for hydrofoil operation. It is thus to be appreciated that where manually operable apparatus is shown, this may be replaced, where appropriate, by suitable powered apparatus.

The apparatus illustrated generally in FIG. 1 comprises a hull 10, a mast 12 and sail apparatus 14. Mounted onto the hull are first and second hydrofoil pair assemblies 16 and 18. At least one of the hydrofoil assemblies 16 and 18 is constructed to be retractable and selectably positionable in accordance with the present invention, while the remaining hydrofoil assembly, if any, may be fixed with respect to the hull or folded in any other way.

It is noted that at least one of and typically both hydrofoil pair assemblies 16 and 18 include two hydrofoils on opposite sides of the craft, each of which comprises first and second generally planar portions 20 and 22, connected in series.

Figure 2:
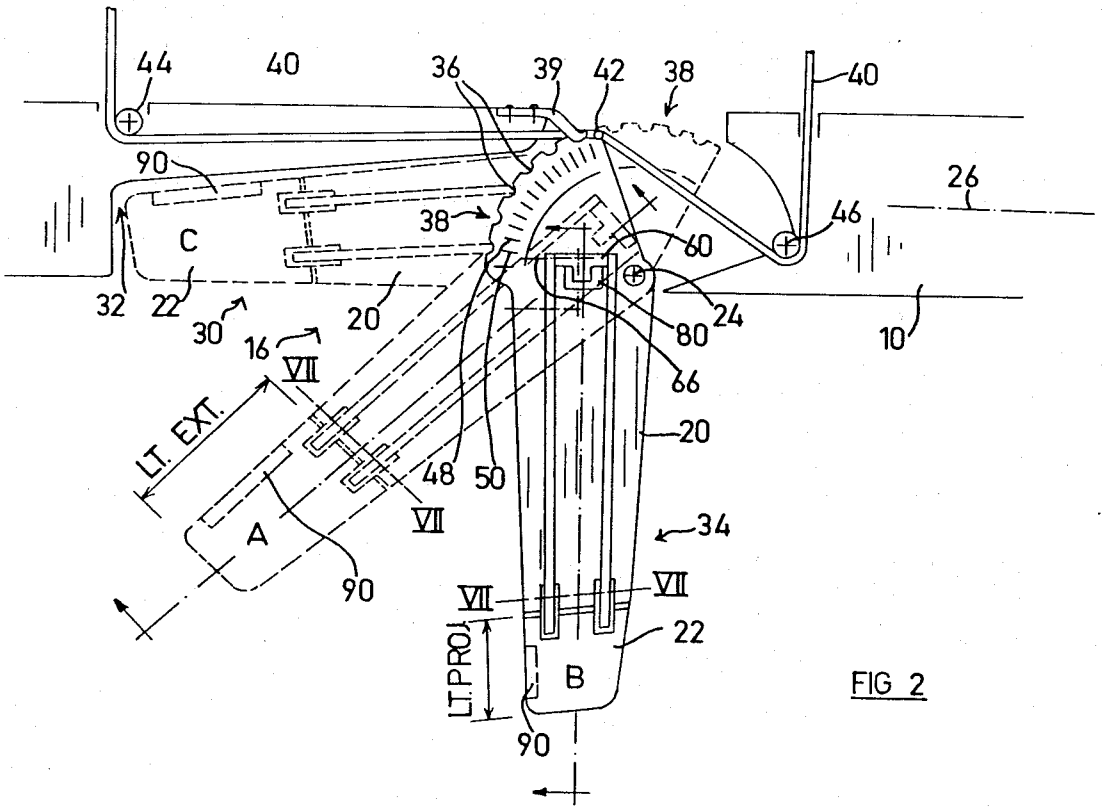
FIG. 2 is a side view illustration of the pivotal mounting of a hydrofoil in accordance with the present invention.

Apparatus for determining the orientation of the retractable and selectably positionable hydrofoil assembly, or assemblies as well as the dihedral angle between portions 20 and 22 thereof, is illustrated in FIG. 2, which shows assembly 16. This apparatus comprises a pivotable mounting, as about a pin or shaft 24 which supports planar portion 20 onto the hull 10. Pin or shaft 24 is normally arranged along an axis extending perpendicularly to the longitudinal axis 26 of the hull.

As is seen in FIG. 2, the hydrofoil assembly 16 may be positioned along a range of positions extending from a fully retracted position, shown in phantom and indicated by reference numeral 30, wherein the hydrofoil assembly is fully seated in an appropriately configured recess 32 formed in the side of the hull 10, to a fully extended postion, shown in solid lines and indicated by reference numeral 34.

The range of positions of hydrofoil assembly 16 may be rendered discrete by providing suitable ratched engagement recesses or protrusions 36 arranged in an arc along the top region 38 of portion 20, for engagement with a suitable ratchet 39 or other selectable retaining means. Determination of the position of hydrofoil assembly 16 may be provided as illustrated by means of a cable 40, which is fixed to a location 42 on top region 38 of portion 20 and extends via respective pulleys 44 and 46 to operator accessible locations above hull 10. Suitable chocks or other retaining means (not shown) may be provided to retain the cable 40 in desired relative positions.

Alternatively to the provision of cable 40 or additionally, the recesses or protrusions 36 at region 38 may be arranged to be engageable by the foot of an operator for determining the orientation of the hydrofoil assembly.

Figure 3:
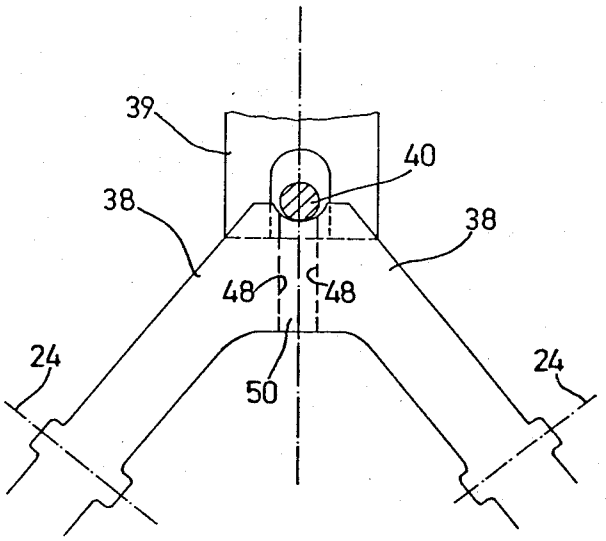
FIG. 3 is an illustration of the interconnection of the two hydrofoils on opposite sides of the sailing craft.

The interengagement and relative orientation of the two hydrofoils on either side of the sailing craft is illustrated in FIG. 3, which illustrates the top regions 38 of the two hydrofoil portions 20 forming the hydrofoil pair, engaged in a bevel gear arrangement, wherein the top inner facing side portions 48 of the respective portions define bevel gear teeth 50. This engagement ensures that both of the hydrofoils move together in retraction and extension. Alternatively, such common motion need not be provided and instead the possibility for differential displacement of the hydrofoils may be provided in order to provide steering or for other purposes.

Figure 4B:
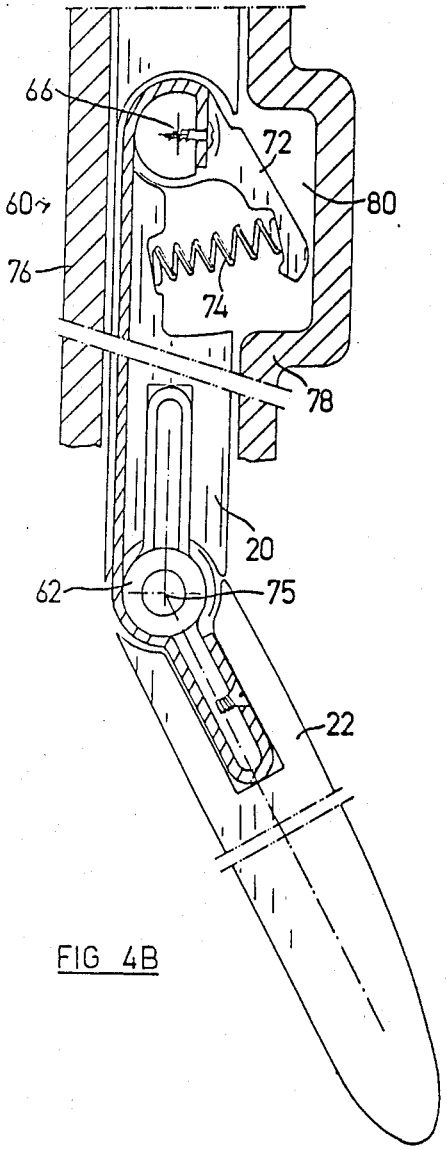
FIGS. 4A and 4B are side view, partially sectional, illustrations of apparatus for determining the dihedral angle between adjacent planar portions of the hydrofoil in accordance with a preferred embodiment of the present invention in respective first and second operative orientations.
Figure 4A:
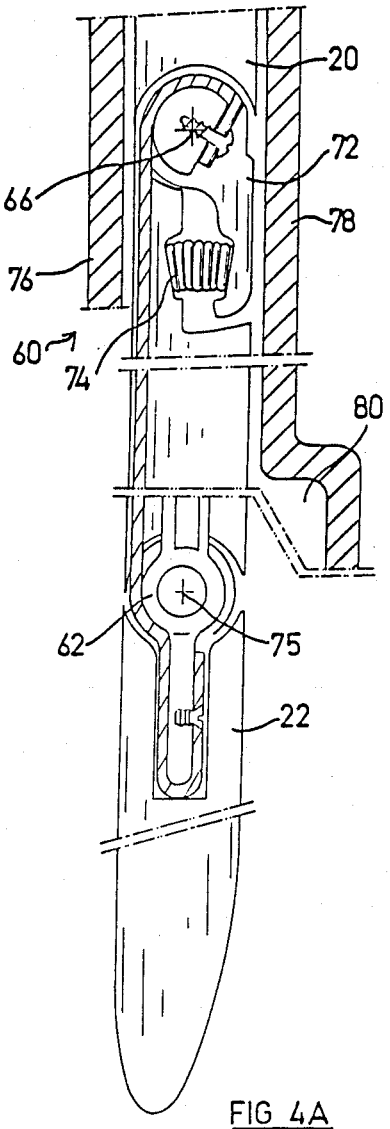

Reference is now made additionally to FIGS. 4A and 4B which illustrate, together with FIG. 2, the apparatus for determining the dihedral angle between portions 20 and 22 of the hydrofoils. Basically, the mechanism used for determining the dihedral angle between portions 20 and 22 of the hydrofoils comprises selectably displaceable strips means which extend along portion 20 from a tensioning assembly 60 associated therewith to a strip displacement responsive hinge 62 joining portions 20 and 22.

Figure 5:
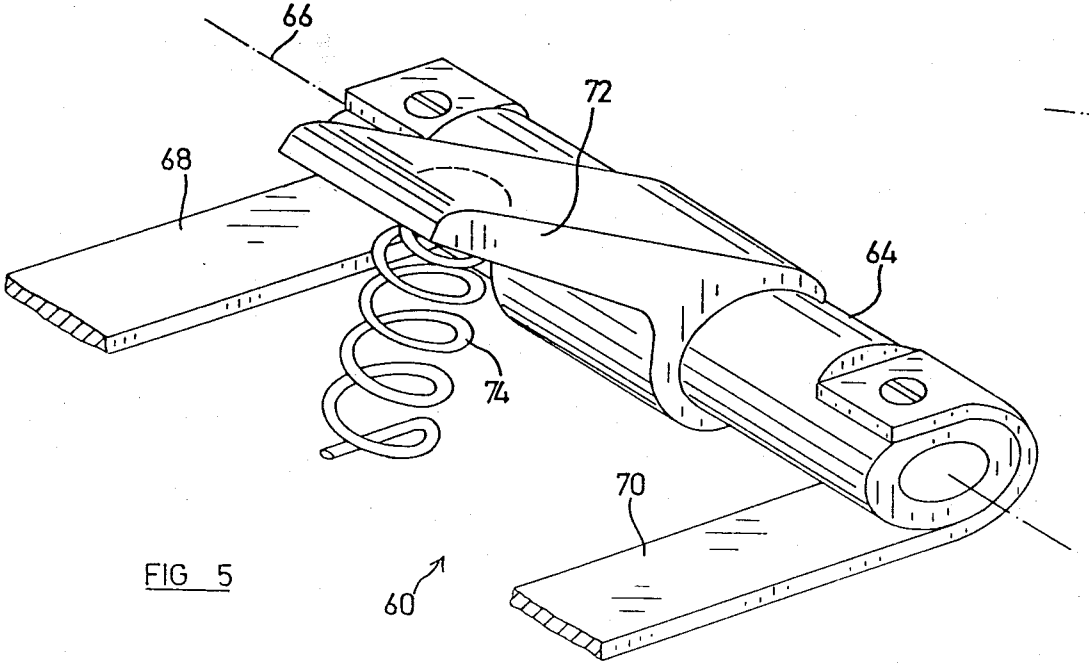
FIG. 5 is a pictorial illustration of a dihedral angle control element forming part of the apparatus of FIGS. 4A and 4B.

Tensioning assembly 60 is illustrated in detail in Fig. 5 and is seen to comprise a pivotable rod 64, which is arranged for pivotable motion about an axis 66, which is fixed with respect to portion 20. Mounted onto rod 64 are first and second tension strips 68 and 70. Also mounted onto rod 64 is is a lever element 72 which is engaged by a spring 74, which normally urges rod 64 into a relaxed orientation wherein strips 68 and 70 are at a minimum tension.

Figure 6A:
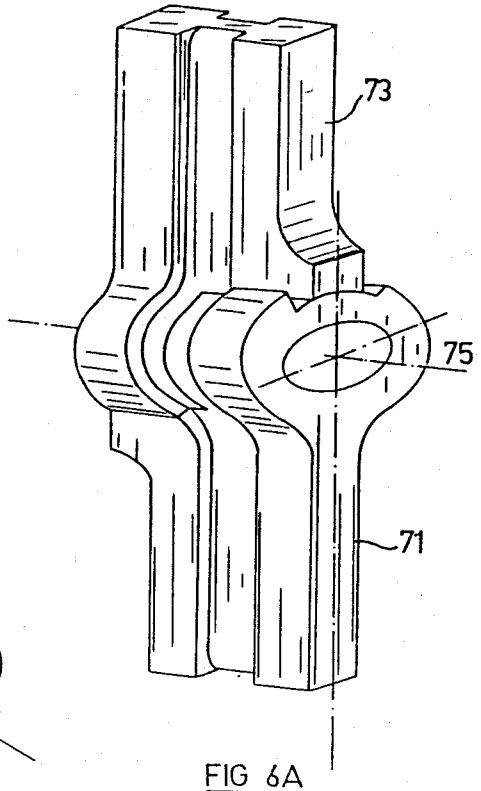
FIGS. 6A and 6B are respective pictorial and side view illustrations of a hinge useful in the apparatus of FIGS. 4A and 4B.
Figure 6B:
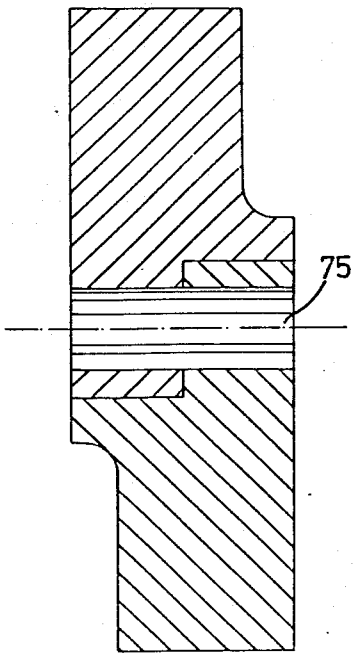

Strip displacement responsive hinge 62 is illustrated in FIGS. 6A and 6B and comprise first and second hinge elements 71 and 73 which are arranged for pivotable motion relative to a hinge axis 75. An end of each strip 68 or 70 is wrapped around a hinge element 71 of each hinge 62 and affixed thereto as seen clearly in FIGS. 4A and 4B. It is thus understood that two hinges 62 or a double hinge are associated with each hydrofoil portion 20.

Returning to FIGS. 4A and 4B it is seen that tensioning assembly 60 is mounted on portion 20 and that portion 20 is pivotably movable between housing wall elements 76 and 78, which are fixed to hull 10. As seen in FIG. 4A, the wall elements 76 and 78 normally restrict the orientation of lever element 72 and cause compression thereof against the urging of spring 74, thus tensioning strips 68 and 70 and causing positioning of hinges 62 as seen in FIG. 4A, maintaining the hydrofoil portion 22 in a uniplanar orientation with portion 22, as illustrated.

According to a preferred embodiment of the invention, housing wall portion is provided with a recess 80, which is positioned such that assembly 66 reaches the recess at a pivotal orientation of the hydrofoil, corresponding to a position where it is desired that a non-zero dihedral angle be defined between portions 20 and 22. Such an orientation is shown in FIG. 4B, wherein assembly 66 is oriented with the recess 80, permitting extension of lever element 72 under the urging of spring 74, thus releasing strips 68 and 72 somewhat. The release of strips 68 and 72 permits displacement of the strips in the downward direction and permits hinges 62 to bend, allowing hydrofoil portion 22 to assume a predetermined, desired, non-zero dihedral angle with respect to portion 20, as illustrated. Normally, the lift force of the water against portion 22 causes it to pivot with respect to portion 20, to assume the orientation illustrated in FIG. 4B.

Figure 7:
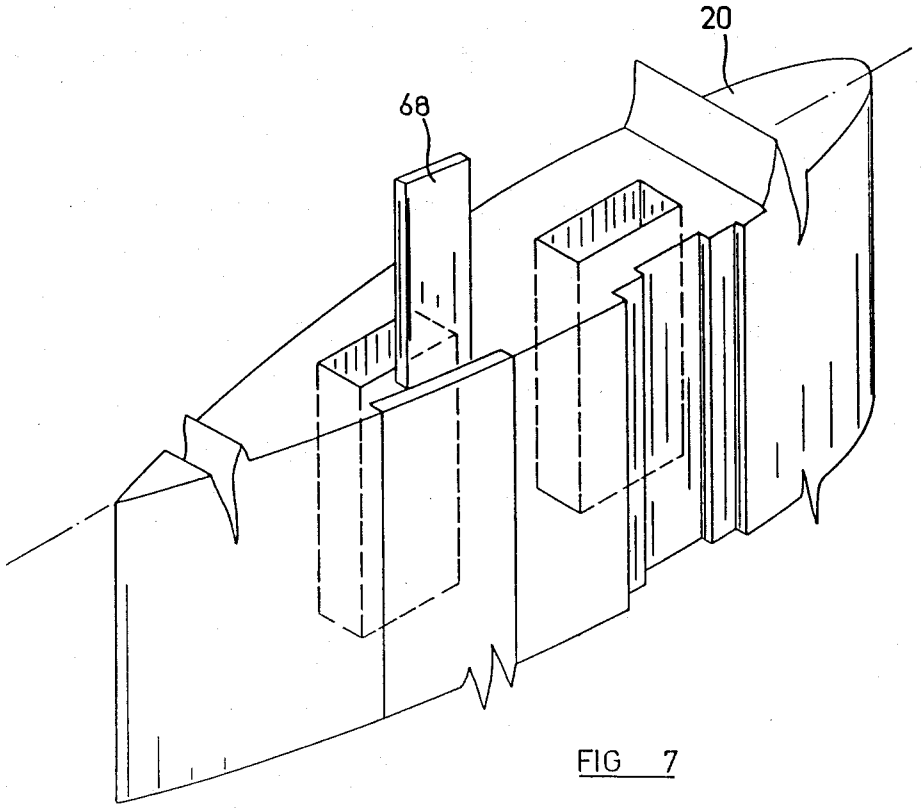
FIG. 7 is a pictorial illustration of a portion of the hydrofoil shown in FIG. 2, in the region indicated by reference lines VII—VII.

Reference is now briefly made to FIG. 7, which illustrates a section of hydrofoil portion 20 including strip 68 and sockets for accomodating hinges 62. This section is taken at lines VII—VII shown in FIG. 2.

It is noted that the operation of strips 68 and 70 may be on a tension basis or alternatively on a push-pull basis. The strips may be formed of high strength reinforced plastic, metal or of any other suitable material.

It is appreciated that additional flaps 90 may be provided on hydrofoil portions 22 as desired. These may be controlled by a strip drive in much the same way as that described hereinabove in connection with FIGS. 4A and 4B and may have separate controls to permit steering or steering assist of the craft by means of such flaps.

It is noted that alternatively or in addition to the apparatus described hereinabove for automatic determination of dihedral angle as a function of the pivotal orientation of the of the hydrofoils, independent control of the dihedral angle may be provided.

It will be appreciated by persons skilled in the art that the present invention is not limited to what has been particularly shown and described hereinabove. Rather the scope of the present invention is defined only by the claims which follow.

I claim:

1. Hydrofoil marine apparatus comprising:

a hull, including at least one recess formed in the underside thereof;

hydrofoil means comprising a plurality of foil assemblies, each assembly including first and second generally planar surface portions, said section portion lying below said first portion when disposed in an operative orientation in the water;

pivotal mounting means for mounting said hydrofoil onto the hull and defining a pivot axis perpendicular to at least one of said first and second generally planar surface portions; and means for selectably and variably determining the dihedral angle between the first and second planar surface portions and comprising:

selectable displacement means associated with said hydrofoil means and operative to assume a first operative orientation when said hydrofoil means is in a first pivotal orientation and to assume a second operative orientation when said hydrofoil means is in a second pivotal orientation;

hinge means joining said first and second generally planar surface portions and operative to determine the dihedral angle therebetween; and means fixedly coupled to said displacement means and to said hinge means for transferring displacement of said displacement means to operation of said hinge means for desired orientation thereof.

2. Hydrofoil marine apparatus according to claim 1 and wherein said first and second planar surface portions are interconnected in series.

3. Hydrofoil marine apparatus according to claim 1 and also comprising flaps disposed on at least one of the first and second planar surface portions.

4. Hydrofoil marine apparatus according to claim 1 and wherein said dihedral angle determining means comprises tensioned element displacement transmission means.

5. Hydrofoil marine apparatus according to claim 1 and wherein said dihedral angle determining means is automatically operable in response to predetermined pivotal positioning of said hydrofoil means.

6. Hydrofoil marine apparatus according to claim 1 and wherein said selectable displacement means comprises:

a first member pivotably mounted onto said hydrofoil means and having mounted thereon said selectable displacement means;

a lever member fixedly mounted onto the first member;

spring means for urging said lever member and said first member into said first operative orientation;

lever position restraining means associated with said hull and operative to define a restricted region and a nonrestricted region, in engagement with said lever for determining the orientation thereof, the restricted region corresponding to positions of said hydrofoil means relative to said hull wherein a first dihedral angle between the first and second portions of said hydrofoil means is required and the unrestricted region corresponding to positions of said hydrofoil means relative to said hull where a second dihedral angle between the first and second portions of said hydrofoil means is permitted.

7. Hydrofoil marine apparatus according to claim 1 and wherein said hydrofoil means comprise a pair of hydrofoils joined by a bevel geared junction.

8. Hydrofoil marine apparatus according to claim 1 and also comprising manually operable means for determining the orientation of said hydrofoil means.

9. Hydrofoil marine apparatus according to claim 1 and also comprising ratchet means for selectably retaining said hydrofoil means in a predetermined orientation.

10. Hydrofoil marine apparatus according to claim 1 and also comprising foot operable means for determining the orientation of said hydrofoil means.

11. Hydrofoil marine apparatus comprising:

a hull, including at least one recess formed in the underside thereof;

hydrofoil means comprising a plurality of foil assemblies, each assembly including first and second generally planar surface portions, said second portion being arranged to lie below said first portion when disposed in an operative orientation in the water;

pivotal mounting means for mounting said hydrofoil onto the hull; and means for selectably and variably determining the dihedral angle between the first and second planar surface portions and comprising:

selectable displacement means associated with said hydrofoil means and operative to assume a first operative orientation when said hydrofoil means is in a first pivotal orientation and to assume a second operative orientation when said hydrofoil means is in a second pivotal orientation;

hinge means joining said first and second generally planar surface portions and operative to determine the dihedral angle therebetween; and means fixedly coupled to said displacement means and to said hinge means for transferring displacement of said displacement means to operation of said hinge means for desired orientation thereof.

12. Hydrofoil marine apparatus according to claim 11 and wherein said first and second planar surface portions are interconnected in series.

13. Hydrofoil marine apparatus according to claim 11 and also comprising flaps disposed on at least one of the first and second planar surface portions.

14. Hydrofoil marine apparatus according to claim 11 and wherein said dihedral angle determining means comprises tensioned element displacement transmission means.

15. Hydrofoil marine apparatus according to claim 11 and wherein said dihedral angle determining means in automatically operable in response to predetermined pivotal positioning of said hydrofoil means.

16. Hydrofoil marine apparatus according to claim 11 and wherein said selectable displacement means comprises:

a first member pivotably mounted onto said hydrofoil means and having mounted thereon said selectable displacement means;

a lever member fixedlymounted onto the first member;

spring means for urging said lever member and said first member into said first operative orientation;

lever position restraining means associated with said hull and operative to define a restricted region and a nonrestricted region, in engagement with said lever for determining the orientation thereof, the restricted region corresponding to positions of said hydrofoil means relative to said hull wherein a first dihedral angle between the first and second portions of said hydrofoil means is required and the unrestricted region corresponding to positions of said hydrofoil means relative to said hull where a second dihedral angle between the first and second portions of said hydrofoil means is permitted.

17. Hydrofoil marine apparatus according to claim 11 and wherein said hydrofoil means comprise a pair of hydrofoils joined by a bevel geared junction.

18. Hydrofoil marine apparatus according to claim 11 and also comprising ratchet means for selectably retaining said hydrofoil means in a predetermined orientation.

19. Hydrofoil marine apparatus according to claim 11 and also comprising foot operable means for determining the orientation of said hydrofoil means.

* * * * *